United States Patent [19]

Meyers

[11] Patent Number: 4,752,393

[45] Date of Patent: Jun. 21, 1988

[54] CONTAMINATION CONTROL BOOM ARRANGEMENT

[76] Inventor: Frank Meyers, 317 Calle Mayor, Redondo Beach, Calif. 90277

[21] Appl. No.: 671,238

[22] Filed: Nov. 14, 1984

[51] Int. Cl.[4] ..... B01D 17/02; E02B 15/04

[52] U.S. Cl. ..... 210/242.3; 210/924; 405/63; 405/72

[58] Field of Search ..... 210/241, 242.1, 242.3, 210/924; 405/63, 66, 72, 69, 71; 114/234

[56] References Cited

U.S. PATENT DOCUMENTS

| | | | |
|---|---|---|---|
| 3,476,246 | 11/1969 | Dahan | 210/242.1 |
| 3,565,254 | 2/1971 | Latimer | 210/242.3 |
| 3,576,108 | 4/1971 | Rowland | 405/72 |
| 3,686,869 | 8/1972 | Manuel | 405/69 |
| 3,710,943 | 1/1973 | Davidson et al. | 210/924 |
| 3,798,911 | 3/1974 | Oberg | 405/69 |
| 3,811,285 | 5/1974 | Ballu | 405/69 |
| 4,068,478 | 1/1978 | Meyers et al. | 405/66 |
| 4,096,700 | 6/1978 | Muramatsu et al. | 405/63 |
| 4,197,204 | 4/1980 | Mathes | 210/924 |
| 4,207,191 | 6/1980 | Webb | 405/63 |
| 4,295,755 | 10/1981 | Meyers | 405/66 |
| 4,342,655 | 8/1982 | Webb | 210/242.1 |
| 4,356,088 | 10/1982 | Matteelli et al. | 210/242.1 |

*Primary Examiner*—Richard V. Fisher
*Assistant Examiner*—Wanda L. Millard
*Attorney, Agent, or Firm*—Don B. Finkelstein

[57] ABSTRACT

An improved contamination control boom having walls defining an elongated hollow flotation chamber. Apertures may be provided in the walls of the flotation chamber to allow material from the body of liquid on which the boom is utilized, which may be the liquid, the contaminant, or a mixture thereof. Pump means may be incorporated to remove the material from the flotation chamber. A float means is positioned inside the flotation chamber to provide a desired freeboard for the condition of liquid in the flotation chamber. Special materials may be utilized to fabricate the boom for high temperature resistant applications where the contaminent is burning, but the boom must continue to operate as a boom during the burning.

19 Claims, 2 Drawing Sheets

CONTAMINATION CONTROL BOOM ARRANGEMENT

BACKGROUND OF THE INVENTION

1. Field of the Invention

This invention relates to a flotation barrier or boom, and, more particularly, to an improved contamination control barrier or boom.

2. Description of the Prior Art

The increased frequency of contamination of bodies of water such as rivers, harbors, ponds, lakes, oceans, and the like, by, for example, chemical spills, oil spills, or other contaminants, has increased the need for effective contamination containment barriers or booms. Such containment barriers or booms are utilized to separate the area of the liquid body having the contamination from adjacent areas of the liquid body. Various types of contamination control booms have heretofore been utilized to achieve this objective. For example, there are disclosed contamination control booms of various forms and configurations in U.S. Pat. Nos. 4,295,755; 4,068,478; 3,798,911; 3,576,108; 3,686,869; 3,811,285; and 3,803,848.

However, in many applications, it has been found advantageous to admit liquid from the liquid body into the interior of the flotation chamber of a contamination control boom. Incorporation of a pump, or other removal means, allows the removal of liquid from the interior of the flotation chamber to some preselected location external the flotation chamber. Thus, if the contaminant, or a mixture of the contaminant and the liquid from the body of liquid is allowed to enter the flotation chamber, it may be pumped to allow, for example, recovery of the contaminant after removal from the interior of the float chamber of the boom.

Additionally, because of the length of booms often required to contain a contaminant within a particular area of the body of liquid, it is often desirable to have such booms flexible enough that they may be compactly stored, for example, axially as described in U.S. Pat. No. 4,068,478, or as wound on a reel or drum, as described in U.S. Pat. No. 4,295,755.

In order to allow liquid from the body of liquid to enter into the float chamber of a contamination control or containment barrier or boom, it is necessary to provide sufficient buoyancy that the liquid entering the flotation chamber (and as utilized herein, the liquid entering the flotation chamber may be the liquid from the body of liquid, the contaminant, or a mixture of the contaminant and the liquid), does not completely fill the flotation chamber and sink the boom. Many of the booms heretofore utilized in the prior art, incorporating a flotation chamber, were of the type which, if liquid entered the flotation chamber, the entire flotation chamber would fill, and the boom, of course, would sink. Consequently, there has long been a need for a contamination control barrier or boom arrangement in which liquid from the body of liquid may be allowed to enter the boom, but the boom would still float and provide the functions for which it is intended.

In yet another application, it has been found desirable to provide a fire resistant contamination control boom. For example, when oil is the contaminant, it is often desired to contain the oil in a particular area of the body of liquid upon which the oil is floating, and burn the oil to remove the oil as a contaminant. Similarly, such applications also involve utilization of a boom to contain an oil spill in which the oil is accidentally burning. The flexible booms of the type mentioned in the above mentioned patents, are not suitable for such an application, in that the temperature associated with the burning oil would destroy the boom. Certain materials, however, which are flexible, have a sufficiently high refractory nature such that they will not be destroyed by the temperature of the burning oil. However, such materials are often somewhat porous and thus would allow liquid from the body of liquid to enter into the flotation chamber when such materials were utilized as the walls of the flotation chamber. Such applications, of course, therefore, require that flotation be provided to insure that the boom remains floating as a boom to provide the boom functions as well as to be resistant to the temperature associated with the burning contaminant.

SUMMARY OF THE INVENTION

Accordingly, it is an object of the present invention to provide an improved contamination control boom arrangement.

It is another object of the present invention to provide an improved contamination control boom arrangement which is flexible, and will remain floating for the condition of liquid from the body of liquid in which the boom is placed, entering into the flotation chamber of the boom.

It is yet another object of the present invention to provide an improved contamination control boom arrangement which is fire resistant and maintains its integrity as a contamination control boom during exposure to burning contaminant on the body of liquid.

Yet another object of the present invention is to provide an improved contamination control boom arrangement which will enable separation and removal of the contaminant.

The above and other objects of the present invention are achieved, according to a preferred embodiment thereof, by providing a contamination control boom of the type adapted to contain a contaminant in a preselected location of a body of liquid. The boom is generally comprised of a flotation chamber means adapted to float on the body of liquid, to which there is affixed a weighted skirt means dependent from the flotation chamber means, and extending downwardly a preselected distance into the body of liquid. The flotation chamber means has walls defining an elongated generally tubular configuration and the walls have an inner surface defining a flotation volume and an outer surface. The boom has a first water line for the condition of no liquid contained within the flotation chamber, and a second water line for the condition of liquid contained within the flotation chamber.

Preferably, the flotation chamber and the skirt are flexible, so that the boom may be conveniently compressed or, alternatively, wound upon a reel or drum during storage, and then deployed as required for utilization. However, it will be appreciated that the principles of the present invention may equally well be utilized in those applications where a more rigid contamination control boom is utilized which does not allow for such compression and/or winding upon a reel or drum. The flotation chamber provides the buoyancy by having air contained within the flotation volume. To aid in maintaining the desired tubular configuration, such as a cylindrical tubular configuration, it may be desired in those applications requiring a flexible contamination control boom, to incorporate an internal structural arrangement such as that disclosed in the above mentioned U.S. Pat. Nos. 4,295,755 or 4,068,478. However, other arrangements for providing such support to achieve the desired tubular configuration may be well utilized in the practice of the present invention. The contamination boom may be fabricated in sections having an axial length as long as required for particular applications. Different sections of such a contamination control boom, in accordance with the principles of the present invention, may be coupled together, for example, by the arrangement shown in the above mentioned U.S. Pat. No. 4,068,478, or any other desired connection means.

An internal float means is positioned in the flotation volume of the flotation chamber, and has a geometrical cross sectional configuration which may be selected as required and the total geometrical cross section configuration of the internal float defines a predetermined portion of the flotation volume. Attachment means, which may be rigid or flexible, depending upon the particular application, couple the internal float means to the flotation chamber means in the flotation volume for restraining the internal float means in a preselected location for the condition of liquid in the flotation volume. The cross sectional configuration of the internal float and the predetermined portion of the flotation volume which the internal float occupies, as well as the position of the internal float within the flotation volume, as defined by the attachment means, determines the second water line for the flotation chamber for the condition of liquid from the body of liquid admitted into the flotation volume of the flotation chamber. That is, the smaller the portion of the flotation volume occupied by the internal float, and the higher the attachment means permits the internal float to be positioned toward the top of the flotation chamber, the greater will be the amount of liquid admitted and the greater the amount of the flotation chamber which is submerged, that is, below the water line, for the condition of liquid contained within the flotation volume. Conversely, the larger the portion of the flotation volume occupied by the flotation means, and the closer to the bottom of the flotation volume that the attachment means allows the internal float to occupy, the lower the water line will be for the condition of liquid contained within the flotation volume, and the less liquid will be allowed to enter into the flotation volume.

To facilitate the entrance of liquid from the body of liquid into the flotation volume, and it will be appreciated, of course, that the liquid entering into the flotation volume may be the contaminant, a mixture of the contaminant and the liquid from the body of liquid, or the liquid itself from the body of liquid, liquid transmitting apertures in the flotation chamber may be provided. Thus, the walls of the flotation chamber means have first edges defining a liquid transmitting aperture means therethrough in a first predetermined spaced array, for allowing liquid to be transmitted therethrough, and thus to enter into the flotation volume. The liquid transmitting aperture means may be spaced axially along the flotation chamber and at least some are positioned below or adjacent the water line for the condition of no liquid contained within the flotation volume. The particular location is selected as desired for particular applications.

If the contaminant to be contained has a specific gravity less than that of the body of liquid, it will float on the surface and comprise a layer of contaminant thereon. In contamination spills in turbulent water such as the ocean, it will be appreciated that there is not a sharp line of demarcation between the layer of contaminant and the liquid from the body of liquid. That is, there is a turbulent area of mixed contaminant and liquid immediately below the layer of contaminant and under that, the liquid itself from the body of liquid. Thus, in some particular embodiments of the present invention, by positioning at least a first portion of the liquid transmitting aperture means in regions adjacent the second water line, that is, the water line when liquid is contained within the flotation chamber, a large proportion of the liquid entering the flotation volume will be the contaminant. In such applications, other, or second portions of the liquid transmitting aperture means are in a spaced array below, or adjacent, the first water line and closer to the attachment point between the dependent skirt means and the flotation chamber.

Such liquid admitting apertures in this application are provided on the side of the boom facing the particular area where the contaminant is to be contained. In many such applications, there are current and wind forces acting on the surface layer of the contaminant. This tends to act as a pump, driving more and more of the contaminant into the flotation volume, through the first portion of the liquid transmitting aperture means and consequently displacing liquid from the body of liquid which may have entered the flotation chamber out of the second portion of liquid transmitting aperture means. This continues to occur until a very large proportion of the liquid contained within the flotation volume is the contaminant and a comparatively small portion thereof is the liquid from the body of liquid.

The walls of the flotation chamber may also have second edges which define air aspiration or vent means which may be generally located in a spaced array along the top of the flotation chamber to allow the aspiration of air therethrough. It will be appreciated that such separate air vent means may not be required in those embodiments of the present invention wherein other air aspiration means may provide the same function. That is, if, for example, at least portions of the walls defining the float chamber means are porous or foraminous or some portions of the liquid admitting apertures may provide such function, or if there are other apertures allowing air to enter and leave the float chamber means as required, the separate air vent means may, if desired, be omitted. Thus, as liquid enters the flotation chamber through the liquid transmitting aperture means, the air displaced thereby exits from the flotation volume through the air vent means, or otherwise.

In some applications it may also be desired to provide a pump means to allow removal of the liquid from the flotation volume. In these applications, a pump means may be secured in the flotation volume and have an inlet below the second water line, so that liquid contained within the flotation volume may be drawn into the pump and an outlet in regions external the flotation chamber, for example, in regions adjacent the top portions or end thereof, so that such liquid as is pumped from the flotation volume may be suitably collected for ultimate disposal.

In one particular application of the present invention, a fire resistant contamination boom arrangement is provided. In many situations, such as an oil spill on the high seas, or other situations, removal of a combustible contaminant, as above described, having a specific gravity less than that of the body of liquid upon which it is spilled, so that it forms a floating layer of contaminant, may not be economically feasible. In such applications, it is often desirable to burn the contaminant and thereby remove its contaminating effect from the body of liquid. In other applications, the burning of the contaminant may be accidental. In order to insure that the contaminant stays within the preselected area of the body of liquid, the contamination control boom must remain functioning as a boom, even during the combustion of the contaminant. Since hydrocarbons are often one of the major contaminant spills, and the temperature to which the flotation chamber means may be exposed during the burning of the hydrocarbons may be on the order of 2300° F., the contamination control boom must be able to withstand such temperatures and still remain functioning as a contamination control boom.

Further, in such applications it is often also desirable to utilize a flexible contamination control boom. The principles of the present invention may be advantageously utilized in such an application. For such a flexible fire resistant contamination control boom, at least portions of the walls defining the flotation chamber are fabricated from a high temperature resistant silicious textile fabric in preselected portions thereof, extending into those regions adjacent at least the second water line for the condition of liquid contained within the flotation volume, and may extend around the top of the flotation chamber. Since such high temperature resistant silicious textile fabrics are often somewhat porous, liquid will generally be admitted therethrough into the flotation volume, and, additionally, it may function as the air vent means. The "wicking" or capillary action of such materials allows the liquid to extend into regions of the flotation chamber which are spaced from the body of liquid and are subjected to the combustion temperatures and, thus, provides cooling of the walls to aid in heat resistance. The liquid transmitting aperture means may, in such an embodiment, be preferably positioned close to the interconnection between the skirt and the flotation chamber so that, preferably, a very large percentage of liquid admitted therethrough is the liquid from the body of liquid, and comparatively small amounts, preferably none, of the contaminant. Therefore, in such an application, it may be desired to provide the liquid transmitting aperture means on the side of the flotation chamber facing away from the contained contaminant, though the opposite side may also be used as desired. If desired, of course, the porous or foraminous nature of the silicious textile fabrics may be utilized to allow admission of the liquid into the float volume, and separate liquid admitting apertures, as well as air vent means, omitted.

The internal float means, contained within the flotation volume is, preferably, surrounded by a flexible plastic layer such as a layer of polyvinyl chloride or polyurethane coated fabric, or other coating or fabric, and a float cover means extends over preselected portions of the float means, for example, along the tops and sides of the float means, and into the liquid contained within the flotation volume. The float cover means is also, preferably, highly resistant to heat, and may, for example, be a glass fiber fabric. Such glass fiber fabric is preferred, since the interstices allow a capillary action to thereby permit a liquid to extend throughout the float cover means to provide a cooling effect to the covering of the internal float means and the float itself.

If desired, the walls of the flotation chamber means in those regions of the refractory high temperature resistant silicious textile fabric may be coated or impregnated with, for example, a polyvinyl chloride, or a polyurethane, upon either the inside or the outside, or both as desired, to provide better handling, shipping, and storing characteristics to the boom, as well as enhancing boom performance. Such coating may tend to burn during the combustion of the contaminant and the porous nature of the flotation chamber walls allows the liquid to enter the flotation 19 chamber.

When such a fire resistant boom arrangement, according to the above described principles of the present invention, is utilized, the contaminant may be set on fire and the fire impinges on the refractory portion of the flotation chamber. Because of the high heat resistant nature thereof, the flotation chamber retains its integrity throughout. Further, because of the addition of the internal float means and the intentional admission of liquid therein, the flotation chamber does not completely fill with liquid, and remains operative as a contamination control boom even during the burn of the contaminant. The thermal insulation and/or cooling effect of the internal float by the float cover maintains the integrity of the internal float to thereby achieve this purpose of maintaining the integrity of the contamination control boom.

The internal float may, if desired, be made of a flexible, closed cell, foam such as polypropylene, polyethylene, polyimide, polyurethane, or similar foam. This prevents the internal float from absorbing liquid which would reduce the buoyancy thereof. Further, for flexible contamination control booms in accordance with the principles of the present invention, which are desired to be wound on a reel or drum for storage when not in use, it may be desirable to provide the internal float in a plurality of layers to allow relative movement therebetween as desirable during the winding on a reel or drum. In the application of a fire resistant boom, it is, of course, desirable that the internal float foam construction be as heat resistant as possible. Therefore, the selection of the various combinations of float material, coating and cover is made to achieve such heat resistance. Further, if the float is fabricated of different layers, different float materials may, if desired, be utilized in each layer.

It will be appreciated that, in certain applications of the invention herein, the internal float means may be provided in the flotation chamber of a contamination control boom arrangement as a safety configuration. That is, if the walls of the flotation chamber in such embodiment, were accidently damaged by ripping, tearing, or otherwise, so that the liquid from the body of liquid enters the flotation volume, the internal float provides sufficient added buoyancy so that the boom does not sink and thus remains functional as a contamination control boom. Therefore, the principles of the present invention may be utilized in a wide variety of contamination control boom arrangements, including those wherein liquid enters the flotation chamber accidently or is intentionally admitted thereto.

Further, as noted above, in many contamination control boom arrangements, separate or intentionally provided apertures for the admission of liquid to the flotation volume need not be provided, since the materials of the flotation chamber, such as a porous or foraminous material, allows the liquid to enter the flotation volume.

Additionally, depending upon the particular location of the means utilized to admit the liquid into the flotation volume, such means may permit the liquid, air, or both, to enter and leave the flotation volume. Thus, such means permit fluids, whether a gas such as the ambient air, or liquid, such as liquid from the body of liquid, which may the liquid alone, the contaminant, or a mixture thereof, to both enter and leave the flotation volume. Those skilled in the art may readily determine the location of such means for allowing the fluid to enter and/or leave the flotation volume.

BRIEF DESCRIPTION OF THE DRAWING

The above and other other embodiments of the present invention may be more fully understood from the following detailed description, when taken together with the accompanying drawing wherein similar reference characters refer to similar elements throughout, and in which.

DESCRIPTION OF PREFERRED EMBODIMENTS

Figure 1:
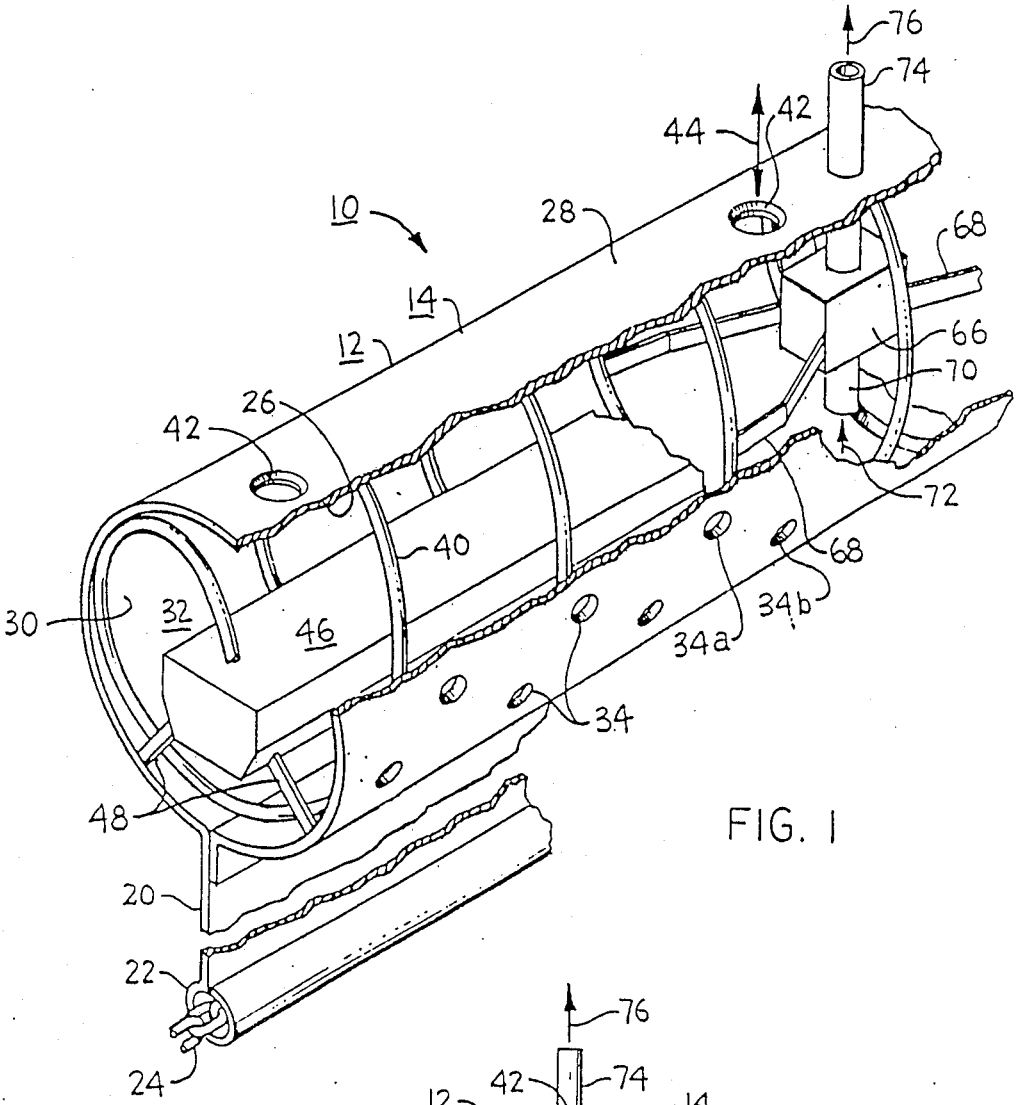
FIG. 1 is a perspective view, in partial section, of a preferred embodiment of the present invention.
Figure 2:
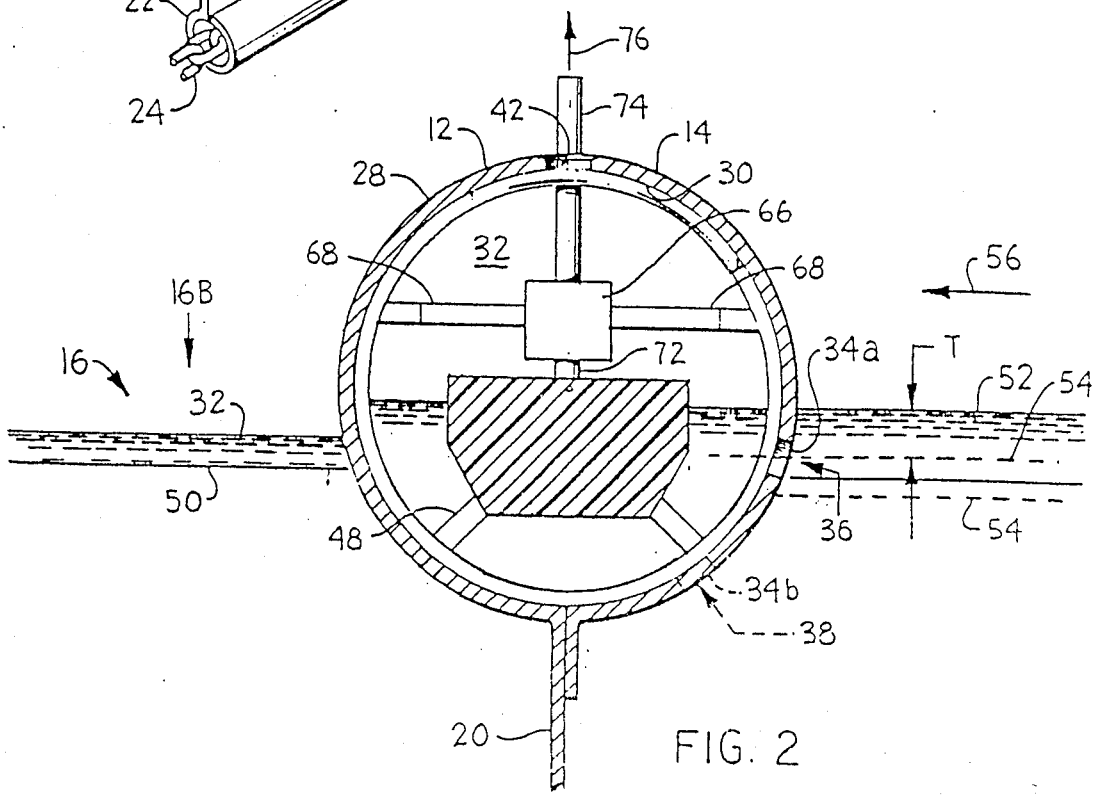
FIG. 2 is a sectional view of the embodiment shown in FIG. 1.

Referring now to the drawing, FIGS. 1 and 2 illustrate a preferred embodiment, generally designated 10, of the present invention of a contamination control boom generally designated 12. The contamination control boom 12 has a flotation chamber means 14 adapted to float on a body of liquid 16. The body of liquid 16 has a contaminant, generally designated 18, therein, in preselected location 16A, and, as illustrated in FIGS. 1 and 2, the contaminant 18 has a specific gravity less than the specific gravity of the liquid of the body of liquid 16, and therefore forms a floating layer, having a thickness indicated by "T" on FIG. 2. The contamination control boom controls the extent of the spread of the contaminant and thereby contains the contaminant 18 in a preselected location of the body of liquid 16.

The contamination control boom 12 also has a weighted skirt means, generally designated 20, coupled to the flotation chamber means 14. The weighted skirt means 20 has a pocket, generally designated 22, in which there may be placed ballast, for example, a chain 24, and the weighted skirt means 20 extends a preselected distance below the surface of the body of liquid 16. It will be appreciated that many other forms of ballasting may be utilized in the practice of the present invention.

The flotation chamber means 14 has walls 26 defining, as illustrated, an axially elongated, generally tubular configuration, and the walls 26 have an outer surface 28 and an inner surface 30. The inner surface 30 defines a flotation volume generally designated 32.

In the embodiment 10, the walls 26 of the flotation 21 chamber 14 have first edges defining first means for allowing fluids to be transmitted therethrough. In the embodiment 10 there are provided fluid transmitting apertures in a preselected spaced array, which, as illustrated, particularly in FIG. 1, is an axially spaced array. A first portion, generally designated **34*a*, of the liquid transmitting aperture means 34, is spaced further from the weighted skirt means 20 than a second portion 34*b* of the liquid transmitting aperture means 34, for purposes as hereinafter described. The liquid transmitting aperture means 34 allows the transmitting of liquid from the body of liquid 16, which may be the liquid 16, the contaminant 18, or a mixture thereof, into the flotation volume 32, as illustrated by the arrows 36 and 38. Depending upon the particular location of the fluid transmitting apertures 34, such apertures may also allow the aspiration of air as well as liquid, or both, into and out of the flotation volume 32. It will be appreciated that while the walls 26 are illustrated in FIGS. 1 and 2** as a single layer, a multi-layer construction of appropriate materials may also be utilized as desired for any particular application.

In the embodiments of the present invention wherein it is desired that the contamination control boom 10 be flexible to allow compact storage, such as by axial compression or by winding on a reel or drum, it is desired that structure be provided in the flotation volume 32 to maintain the tubular configuration of the flotation chamber 14. As such, it may be desired to incorporate a wire like helical means, generally designated 40, and as described in U.S. Pat. No. 4,068,478. Alternatively, it may be desired to incorporate such structure as shown in U.S. Pat. No. 4,295,755 for the same purpose, depending upon the type of storage compaction desired.

Wire like helical means 40 is a wire like means which engages the internal surface 30 of the flotation chamber 14 for restraining the flotation chamber means in, as shown in FIGS. 1 and 2, generally circular cross section configuration, which thereby provides the buoyancy of the flotation chamber 14. The walls 26 of the flotation chamber 14 may, if desired, also be provided with second edges defining air vent means, generally designated 42, to allow the aspiration of air into and out of the flotation volume 32, as indicated by the double ended arrow 44.

An internal float means, generally designated 46, is positioned within the flotation volume 32 and has a predetermined geometrical cross sectional configuration which defines a predetermined portion of the flotation volume 32. Attachment means 48 are coupled to the internal float means 46 for restraining the internal float means 46 at a predetermined location within the flotation volume 32. The smaller the portion of the flotation volume occupied by the internal float means, and the further from the weighted skirt means 20 that the float means 46 is positioned by the attachment means 48, the less buoyancy and freeboard will be provided by the internal float means 46 for the condition of liquid within the flotation volume 32. Therefore, the length of the attachment means 48 and the size of the float 46 are selected to provide the desired degree of buoyancy and freeboard for particular applications.

As noted above, the provision of an internal float, such as float means 46, in the flotation volume is also advantageous in embodiments of the present invention wherein no fluid transmitting apertures 34 are provided in order to insure the viability of the boom in the event of, for example, accidental rupturing of the flotation chamber walls.

It will be appreciated that, depending upon the application, the attachment means 48 may be flexible or rigid. In those embodiments of the present invention incorporating a wire like helical means 40, the internal float 46 may be attached by the attachment means 48 to the wire like helical means 40.

As illustrated more clearly in FIG. 2, the flotation chamber 14 may have a first water line, generally designated 50, for the condition of no liquid contained within the flotation volume 32, and a second water line, generally designated 52, for the condition of liquid contained within the flotation volume 32. It will be appreciated, of course, that the second water line 52 is further from the weighted skirt means 20 than the first water line 50, thereby reducing the freeboard of the flotation chamber 14.

In the embodiment 10, the second portion of liquid transmitting aperture means 34*b* is positioned between the first water line 50 and the weighted skirt means 20, and, preferably, in regions in which mostly liquid from the body of liquid 16 and very little of the contaminant 18 will be admitted into the flotation volume 32 therethrough. The first portion 34*a* of the liquid transmitting aperture means 34 is positioned in regions adjacent the layer of contaminant 18 for the condition of liquid in the flotation volume 32.

The interface, generally illustrated by the dotted line 54, between the contaminant layer 18 and the liquid contained within the body of liquid 16, is, in many instances, not a clearly defined plane of demarcation, but rather comprises a turbulent layer of a mixture of the contaminant and the liquid from the body of liquid 16. Therefore, those skilled in the art can determine the proper location of the contaminant layer 18, as well as the position of the liquid transmitting aperture means 34, to achieve the desired purposes of the present invention, depending upon, of course, the particular type of contaminant 18, and the wind and surface conditions, as well as the type of liquid 16.

In many instances, the contaminant layer 18 is, preferably, contained in the preselected location 16A on the body of liquid 16 which is on the windward/current side of the flotation chamber 14, as illustrated in FIG. 2, in which the wind/current direction is shown by the arrow 56. That is, the combination of both the wind and current often result in a net movement of the contaminant layer in a particular direction. Such direction is, for convenience, designated herein as the windward side of the boom. It has been found that under such conditions, when the boom 12 is deployed on the body of liquid 16 to contain the contaminant 18 within a preselected area 16A of the body of liquid 16, and to prevent the contaminant 18 from spreading into the area 16B of the body of liquid 16, and there is wind/current present as indicated by the arrow 56, the wind, current and/or wave action on the windward side of the boom 12, where the contaminant 18 is contained, acts as a pump and tends to force more of the contaminant through the first portion of liquid transmitting aperture 34*a* into the flotation volume 32. Under such conditions, liquid is forced from the flotation volume 32 through apertures 34B, as indicated by the arrow 38*a* and, gradually, more and more of the liquid contained within the flotation volume 32 is comprised of the contaminant 18.

In order to remove the liquid contained within the flotation volume 32, a fluid pump means, generally designated 66, may be provided in the flotation volume 32, and restrained therein by restraining means, generally designated 68, which provides attachment to, for example, the wire like helical means 40. Other attachment means and attachment locations may be utilized as desired in particular applications. The fluid pump 66 has an inlet 70 to allow the admission into the fluid pump 66 of liquid from the liquid contained within the flotation volume 32, as illustrated by the arrow 72, and a discharge 74, to allow discharge of such liquid as illustrated by the arrow 76, to regions external the flotation chamber 14. It will be appreciated that a "skimmer" type of inlet 70, such as a flexible perforated manifold pipe or tube (not shown) extending axially along the float means 46, may be incorporated in various applications 1 of the present invention, as desired for any particular application. The pump 66 may, of course, be located in positions other than within the flotation volume, for example, external the flotation chamber.

Under the wind and current conditions as described above, and as illustrated in FIG. 2, it has been found, for example, that the water line on the windward side of the flotation chamber 14 will be higher than the water line on the leeward side thereof. However, in such situations, the liquid level contained within the flotation volume 32 is approximately equivalent to the second water line 52. Further, it will be appreciated that the liquid transmitting apertures may be placed on the leeward side of the flotation chamber 14 as may be desired for particular applications, in addition to, or in place of, the liquid admitting apertures 34 shown on the windward side thereof.

The flotation chamber and the weighted skirt means may be fabricated, for example, of polyvinyl chloride, or other desired materials. The internal float means 46 may be fabricated, for example, from a closed cell foam such as polypropylene, polyurethane, or the like, and, if desired, and as described below in greater detail, be provided with an outer coating of polyvinyl chloride, a polyvinyl or polyurethane coated polyester, or similar materials useful for such purposes.

Figure 3:
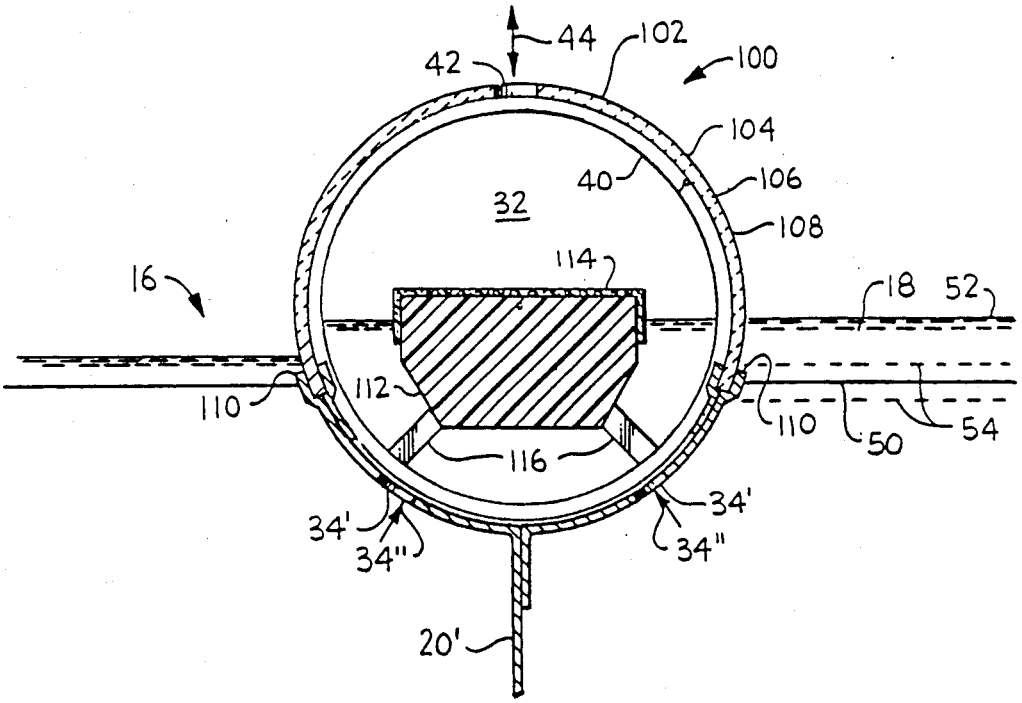
FIG. 3 is a sectional view of another embodiment of the present invention.

FIG. 3 illustrates another embodiment, generally designated 100, utilizing the present invention in a fire resistant contamination control boom, generally designated 102. The general configuration of the contamination control boom 102 is similar to the configuration of the contamination control boom 14 described above. However, in the contamination control boom 102, the walls 104, defining the flotation chamber means 106, have at least a portion thereof, generally designated 108, comprised of a high temperature resistant refractory material such as a high silica textile fabric. Such materials often tend to be somewhat porous, thereby admitting liquid into the internal volume 32 of the flotation chamber 104. In the construction of the boom 102, the weighted skirt means 20', which may be generally similar to the weighted skirt means 20, extends only partially around the flotation chamber means 106, where it is provided with a pocket means 110 on each side thereof for sandwiching the refractory material 108 therebetween, and may be secured therein by, for example, sewing, bonding, heat sealing, or the like, depending upon the particular combination of materials utilized. Alternatively, the refractory material 108 may be detachably secured to pockets 110 by snaps, ties or similar structures. Such detachable coupling allows convenient replacement of 18 refractory material 108 or, if desired, replacement of the refractory material 108 with other materials having desired structural characteristics for particular applications.

An internal float means, generally designated 112, is positioned within the flotation volume 32, for the same purposes as the internal float 46 of the embodiment 10 described above. However, in the fire resistant boom 102 it is preferred to provide a blanket or covering of a glass fiber fabric 114, on the internal float means 112, and such blanket or cover 114 extends into the liquid contained within the flotation volume 32. A preferred form of the internal float 112, as utilized in the fireproof boom 102 is described below in connection with FIG. 4.

A plurality of fluid transmitting aperture means 34' in the flotation chamber 106 may be provided on the side of the boom having the contaminant layer 18 thereon, or on the side of the flotation chamber 106 away from the contaminant layer 18, as indicated by the apertures 34", or on both sides, as may be desired in particular applications. Alternatively, the porous or foraminus structure of the portion 108 of the walls 104 may function as the fluid transmitting aperture means. However, in a fire resistant boom arrangement, as illustrated in the embodiment 100 shown on FIG. 3, it may be preferred that the apertures 34' or 34" be in regions wherein primarily liquid from the body of liquid 16, are admitted into the flotation volume 32, and comparatively little of the contaminant 18. The considerations given to the size of the internal float 112, as well as the length of the attachment means 116, may be utilized in the design considerations of the fire resistant boom 102. Thus, the internal float 112 provides the necessary buoyancy to insure that the contamination control boom 102 maintains its integrity during the burning of the contaminant 18.

It will be appreciated that, as noted above, the porous material of the flotation chamber may be coated on the inside surface, outside surface, or both, with a polymer material such as polyvinyl chloride, polyurethane, or the like. Such coating tends to burn away during the combustion of the contaminant and thus allows the porous nature of the float chamber walls to act as fluid transmitting aperture means.

Figure 4:
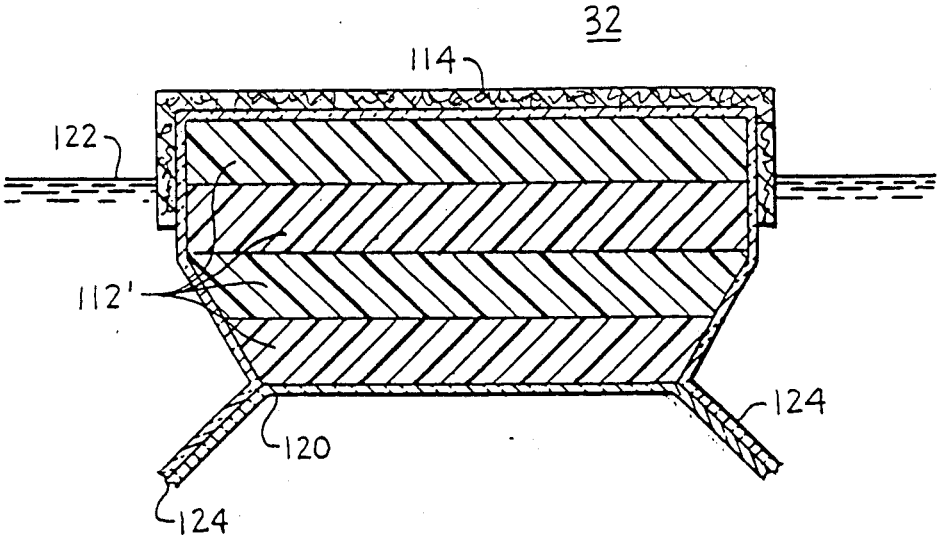
FIG. 4 is a sectional view of an internal float means useful in the practice of the present invention.

FIG. 4 illustrates the preferred form of the internal float 112. As shown in FIG. 4, the internal float 112 may be comprised of a plurality of layers 112', to allow convenient compaction, for example, by rolling the boom 102 on a drum. A layer 120 of, for example, polyvinyl chloride, or polyurethane coated nylon or polyester fabric may be provided around the internal float 112, to prevent liquid from entering the internal float 112, and to provide additional protection to the internal float 112. Additionally, if desired, the layer 120 may include tabs or flaps extending axially therealong which may be utilized as the attachment means for securing the float 112 to the flotation chamber means 106. Alternatively, such flaps 124 may be utilized as the location for coupling separate attachment means such as attachment means 116 (FIG. 3). It will be appreciated that the internal float 112 with layer 120, as shown in FIGS. 4, may equally well be utilized in the embodiment 10 described above. The layers 112' of the internal float 112, may thus be a closed cell polypropylene foam, polyurethane foam, or other similar closed cell materials.

In those applications wherein a flexible float 112 is desired, the preferred materials are polypropylene, polyethylene and flexible polyimide. Where a more rigid float 112 is desired, the preferred materials are polyurethane and rigid polyimide. If the float 112 is fabricated in a multi-layer construction, it will be appreciated that the layers may be of different materials.

The float cover 114 is, preferably, a glass fiber textile, which has a high temperature resistance capability. Additionally, as shown in FIG. 4, the cover 114 extends below the level illustrated at 122 of the liquid contained in the flotation volume 32. The glass fiber fabric, through its capillary action, allows dispersion of the liquid contained within the flotation volume 32, around the internal float 112, to provide additional cooling thereof, and thus resistant to the effects of high temperature during the burning of the contaminant layer 18. In order to prevent contamination of the cover 114 by the contaminant 18, it is preferred that most or all of the liquid contained within the flotation volume 32 be the liquid 16, rather than the contaminant 18.

The internal float of the present invention also functions as a containment barrior or boom within the flotation volume of the flotation chamber means. Thus, the internal float aids in restricting the contaminant to those portions of the flotation volume on the side thereof adjacent the contaminant layer.

It will be appreciated that the boom 102 construction, as shown in FIG. 3, may often be advantageously utilized in applications such as those described above in connection with embodiment 10 by incorporation of suitable contaminant removal means such as pump 66.

This concludes the description of the preferred embodiments of applicant's invention. Those skilled in the art may find many variations and adaptations thereof, and all such variations and adaptations, falling within the true scope and spirit of applicant's invention, are intended to be covered thereby.

What is claimed is:

1. In a contamination control boom of the type adapted to contain a contaminant in a preselected location of a body of liquid, and the boom having a flotation chamber means adapted to float on the body of liquid and having a first water line for the condition of no liquid containing within the flotation chamber and second water line for the condition of liquid contained in the flotation chamber, and the boom having a weighted skirt means dependent from the flotation chamber means and extending downwardly a preselected distance into the body of liquid, the improvement comprising:

a flotation chamber means having walls defining an elongated, generally tubular configuration, and said walls having an inner surface defining a flotation volume and an outer surface;

internal float means in said flotation volume and having a predetermined geometrical cross section configuration defining a predetermined portion of said flotation volume, said internal float means extending axially in said flotation volume of said flotation chamber in the elongated direction thereof and free of sealing relationship with said walls of said flotation chamber for allowing liquid to flow in said flotation volume in the elongated direction; and attachment means for coupling said internal float means to said flotation chamber means for restraining said internal float means in a preselected location in said flotation volume for the condition of liquid in said flotation volume.

2. The arrangement defined in claim 1 and further comprising:

first means in said walls of said flotation chamber comprising means for allowing fluids to be transmitted therethrough.

3. The arrangement defined in claim 2 and further comprising:

second means in said walls of said flotation chamber means for allowing aspiration of air into and out of said flotation volume.

4. The arrangement defined in claim 2, wherein:

said first means further comprises first edges defining liquid transmitting aperture means therethrough in a first predetermined spaced array for allowing liquid to be transmitted therethrough; and said first predetermined spaced array of said first edges defining said liquid transmitting aperture means comprising a first portion in regions adjacent the second water line of said flotation chamber means for the condition of liquid in said flotation volume.

5. The arrangement defined in claim 3 wherein:

said second means further comprises second edges defining air transmitting aperture means therethrough in a second predetermined spaced array for allowing air to be transmitted therethrough; and said second predetermined spaced array of said second edges defining said air transmitting means is above the second water line for the condition of liquid from the body of liquid in said flotation volume.

6. The arrangement defined in claim 2 and further comprising:

pump means having an inlet in said flotation volume and an outlet external said flotation chamber means for pumping contents from said flotation volume to preselected regions external said flotation chamber means.

7. The arrangement defined in claim 2, wherein:

said flotation volume is generally circular in cross section, and further comprising:

a wire like helical means engaging said internal surface of said walls of said flotation chamber means for restraining said flotation chamber means in said generally circular cross sectional configuration.

8. The arrangement defined in claim 7, wherein:

said attachment means are coupled to said wire like helical means.

9. The arrangement defined in claim 4, wherein:

a second portion of said first predetermined array of said liquid transmitting aperture means is in regions below the first water line of the flotation chamber means for the condition of no liquid in said flotation volume.

10. The arrangement defined in claim 2 or 6, wherein the contaminant has a specific gravity less than the specific gravity of the body of liquid and the contaminant comprises a layer having a predetermined thickness floating on the body of liquid, and wherein:

said first means further comprises first edges in said walls of said flotation volume means defining liquid transmitting aperture means in a first preselected spaced array for allowing liquid to be transmitted therethrough, and a first portion of said liquid transfer aperture means is positioned below the second water line and in regions at least partially within the thickness of the layer of contaminant; and a second portion of said liquid transmitting aperture means is positioned below the first water line.

11. The arrangement defined in claim 2 or 6, wherein the contaminant has a specific gravity less than the specific gravity of the body of liquid and the contaminant comprises a layer having a predetermined thickness floating on the body of liquid, and wherein:

said first means further comprises first edges in said walls of said flotation volume means defining liquid transmitting aperture means in a first preselected spaced array for allowing liquid to be transmitted therethrough, and a first portion of said liquid transmitting aperture means is positioned below the second water line and in regions adjacent the interface between the bottom of the layer of contaminant and the top of the body of liquid.

12. In a contamination control boom of the type adapted to contain a contaminant in a preselected location of a body of liquid, and the boom having a flotation chamber means adapted to float on the body of liquid and having a first water line for the condition of no liquid contained within the flotation chamber and a second water line for the condition of liquid contained in the flotation chamber, and the boom having a weighted skirt means dependent from the flotation chamber means and extending downwardly a preselected distance into the body of liquid, the improvement comprising:

a flotation chamber means having walls defining an elongated, generally cylindrical tubular configuration, and said walls having an inner surface defining a flotation volume having a generally circular cross sectional configuration, and an outer surface;

a wire like helical means engaging said inner surface of said walls of said flotation chamber means for restraining said flotation volume in said generally circular cross sectional configuration;

internal float means in said flotation volume and having a preselected geometrical cross sectional configuration defining a predetermined portion of said flotation volume, and said internal float means comprised of a closed cell plastic foam;

flexible attachment means coupled to said wire like helical means and said internal float means, for coupling said internal float means to said flotation chamber means and restraining said internal float means in a preselected location in said flotation volume for the condition of liquid in said flotation volume;

pump means having an inlet in said flotation volume and an outlet external said flotation chamber means for pumping liquid from said flotation volume to preselected regions external said flotation chamber means;

said walls of said flotation chamber means having first edges defining liquid transmitting aperture means therethrough in a first predetermined spaced array for allowing liquid from the body of liquid to be transmitted therethrough, and a first portion of said first predetermined spaced array is adjacent the preselected location of the body of liquid having the contaminant;

said walls of said flotation chamber means having second edges defining air vent means therethrough in a second predetermined spaced array for allowing air to be transmitted therethrough, and said second predetermined spaced array is above the first water line for the condition of liquid from the body of liquid in said flotation volume; and weighted skirt means coupled to said flotation chamber means and extending downwardly therefrom a predetermined distance into the body of liquid.

13. In a fire resistant contamination control boom of the type adapted to contain a contaminant in a preselected location of a body of liquid, and the boom having a flotation chamber means adapted to float on the body of liquid and having a first water line for the condition of no liquid contained within the flotation chamber and a second water line for the condition of liquid contained in the flotation chamber, and the boom having a weighted skirt means dependent from the flotation chamber means and extending downwardly a preselected distance into the body of liquid, the improvement comprising:

a flotation chamber means having walls defining an elongated, generally tubuar configuration, and said walls having an inner surface defining a flotation volume and an outer surface, and at least a portion of said walls comprised of a high temperature resistant, silicious textile fabric;

internal float means in said flotation volume, having a preselected geometrical cross sectional configuration, and defining a predetermined portion of said flotation volume, said internal float means extending axially in said flotation volume of said flotation chamber in the elongated direction thereof and free of sealing relationship with said walls of said flotation chamber for allowing liquid to flow in said flotation volume in the elongated direction, and said internal float means having a float cover on preselected surface portions thereof, and said float cover comprising a temperature insulating cover; and attachment means having a predetermined length for coupling said internal float means to said flotation chamber means for restraining said internal float means in a preselected location in said flotation volume for the condition of liquid in said flotation volume.

14. The arrangement defined in claim 13, wherein:

said internal float means further comprises a plurality of layers of closed cell foam.

15. The arrangement defined in claim 14, wherein:

each of said layers of said foam of said internal float means comprises one of a polypropylene, a polyurethane, a polyimide and a polyethylene foam;

float cover means further comprises a flexible layer of glass fiber fabric, and a preselected portion thereof extending into liquid within the float volume; and an intermediate internal float layer extending around said layers of foam and intermediate said foam and said float cover.

16. The arrangement defined in claim 13, wherein:

said walls of said flotation chamber means further comprise a polymer coating on said outside surface.

17. The arrangement defined in claim 16, wherein:

said coating is one selected from the group consisting of polyvinyl chloride, polyurethane and polyethylene.

18. The arrangement defined in claim 15, wherein:

said attachment means comprises tablike members of said intermediate internal float layer.

19. The arrangement defined in claim 13 and further comprising:

first means in said walls of said flotation chamber comprising means for allowing fluids to be transmitted therethrough.

* * * * *